United States Patent [19]

Gulmatico, Jr.

[11] Patent Number: 4,830,509

[45] Date of Patent: May 16, 1989

[54] AUTOMATIC SYSTEM FOR DISSOLVING DRY DETERGENT

[76] Inventor: Ramon Gulmatico, Jr., 4200 Stanbridge Ave., Long Beach, Calif. 90808

[21] Appl. No.: 207,547

[22] Filed: Jun. 16, 1988

[51] Int. Cl.[4] ..... G05D 11/02; B01F 15/02

[52] U.S. Cl. ..... 366/153; 222/129; 366/155

[58] Field of Search ..... 366/142, 151, 153, 154, 366/155, 156, 167, 168, 241, 242; 222/651, 129, 64; 422/119, 264; 68/17 R

[56] References Cited

U.S. PATENT DOCUMENTS

| | | | |
|---|---|---|---|
| 2,698,163 | 12/1954 | Swensen | 366/153 |
| 3,223,285 | 12/1965 | Anderson . | |
| 3,326,530 | 6/1967 | Schlernitzauer . | |
| 3,738,534 | 6/1973 | Abbott | 366/153 |
| 3,826,408 | 7/1974 | Berndt et al. . | |
| 3,860,394 | 1/1975 | Tepas, Jr. et al. . | |
| 3,975,931 | 8/1976 | Bischkopf | 68/17 R |
| 4,160,367 | 7/1979 | Vona, Jr. | 68/17 R |
| 4,362,033 | 12/1982 | Young | 366/153 |
| 4,364,666 | 12/1982 | Keyes | 366/142 |
| 4,444,730 | 4/1984 | Renders et al. . | |
| 4,462,511 | 7/1984 | Fulmer et al. | |
| 4,474,476 | 10/1984 | Thomsen | 366/153 |
| 4,490,047 | 12/1984 | Stegemoeller et al. | 366/153 |
| 4,571,092 | 2/1986 | Switall | 366/153 |
| 4,687,121 | 8/1987 | Copeland . | |

*Primary Examiner*—Robert W. Jenkins

*Attorney, Agent, or Firm*—Charles H. Thomas

[57] ABSTRACT

A device is provided for dissolving dry detergent to provide a liquid detergent solution to washing machines in a laundry. A tank is divided into upper and lower compartments. The upper compartment drains into the lower compartment when a tank valve therebetween is opened, and the compartments are maintained in mutual isolation when the tank valve is closed. High and low liquid level sensors in the upper compartment control mixing and dispensation of detergent solution. A quantity of dry, solid powdered detergent is mixed with a predetermined quantity of water in the upper compartment while the upper and lower compartments are isolated from each other during a mixing cycle. During the mixing cycle the lower compartment serves as a reservoir for supplying liquid detergent solution to one or more washing machines. Following the mixing cycle, the contents of the upper compartment are allowed to drain into the lower compartment.

20 Claims, 4 Drawing Sheets

AUTOMATIC SYSTEM FOR DISSOLVING DRY DETERGENT

BACKGROUND OF THE INVENTION

1. Field of the Invention

The present invention relates to a device for dissolving dry detergent in a solvent and for providing liquid detergent solution to washing machines in a laundry.

2. Description of the Prior Art

In large commercial laundries powdered or granulated solid detergent is normally utilized in preference to liquid detergents. The use of solid detergent is preferred because solid detergent is far less expensive than detergent provided in the form of a liquid solution. However, the laundry equipment required to utilize such dry detergents requires large pumps and voluminous tanks and is quite expensive. Due to the high capital expense of the laundry equipment involved and the relatively large space requirement for the laundry equipment which utilizes solid detergents, many smaller laundries do not utilize solid detergent, but instead employ liquid detergent solutions.

Most hotels, motels and hospitals have smaller laundry facilities than large commercial laundries, and utilize liquid detergent as a matter of convenience. That is, liquid detergent can be pumped, conveyed and fed through conduits to washing machines within a smaller space and with less complexity than is required for solid detergents. Nevertheless, the cost of liquid detergent is approximately thirty percent greater than that of a quantity of solid detergent necessary to perform a corresponding amount of washing.

SUMMARY OF THE INVENTION

The present invention provides an apparatus for dissolving solid detergent to form a liquid detergent solution and thereby enable the use of solid detergent in smaller laundries, such as those of hotels, motels and hospitals. The device of the invention provides for compact and simplified automatic or semi-automatic mixing of solid detergent into a liquid solution. The liquid detergent solution so produced can then be used in the existing laundry equipment at such installations.

A principal object of the invention is to provide a system for converting detergent that is provided in solid, powder or granular form into a liquid solution without requiring expensive and voluminous pumps and tanks. The apparatus of the invention is compact and may be readily connected to conventional washing machines in laundry facilities. The invention allows smaller laundries to reduce their detergent costs by utilizing dry detergent in solid form while still retaining the convenience of use of liquid detergents.

The apparatus of the invention is relatively economical, and the capital expense of purchase is rapidly recovered due to the large cost savings which result from the use of solid detergent as contrasted with liquid detergent. Furthermore, detergent in solid powder or granular form is safer and easier to handle than detergent in liquid form. Also, solid detergent can be stored in a much smaller storage area as contrasted with a corresponding amount of liquid detergent sufficient to perform equivalent washing. The present invention allows detergent to be used in a more cost effective manner, since relatively inexpensive dry detergent chemicals are converted into liquid solution form right on the laundry premises.

The unique equipment configuration of the detergent liquification system of the present invention allows solid detergent to be dissolved in a laundry at only a fraction of the cost of commercial detergent liquification systems. Such conventional systems require an expense on the order of $25,000.00 for the purchase of the necessary capital equipment. The apparatus of the present invention requires a capital expense of only approximately $1,000.00 to $1,500.00.

In one broad aspect the present invention may be considered to be an apparatus for dissolving solid detergent for use in a laundry. The apparatus is comprised of a tank having upper and lower compartments and a coupling tank valve located between the upper and lower compartments. The tank valve is selectively operable to permit communication between the compartments and, alternatively, to isolate the compartments from each other. A liquid outlet is provided from the lower compartment and both compartments are vented to atmosphere. An agitator and a liquid inlet with an inlet valve therein are provided in the upper compartment. The inlet valve is selectively operable between open and closed positions. A high level indicator for producing a high level signal when liquid in the upper compartment rises to a predetermined high level is also provided. The system also includes a low level indicator for producing a low level signal when liquid in the upper compartment falls to a predetermined low level.

A mixing timer means is provided for producing a timing signal a predetermined interval after actuation. The system further includes cycling means which closes the tank valve and opens the inlet valve in response to the low level signal. The cycling means thereafter actuates the agitator and the mixing timer means in response to the high level signal. The cycling means further deactuates the agitator and opens the tank valve in response to the timing signal.

In a simple, basic form the apparatus of the invention employs a tank which is divided into upper and lower compartments by a transverse partition. A tank valve in the partition is operated by a solenoid to alternatively allow liquid to flow from the upper to the lower compartment, or to isolate the upper and lower compartments from each other. Both compartments are vented to atmosphere, preferably by a standpipe extending vertically upwardly from the lower compartment through the upper compartment. The upper compartment includes both high and low liquid level limit sensors and a motor driven mixer.

The upper compartment is capable of functioning as a mixing vessel, while the lower compartment currently functions as a storage or delivery vessel so as to satisfy the chemical requirements of washing machines or other types of cleaning equipment. During the mixing cycle the upper and lower compartments are isolated from each other by a solenoid operated tank valve located in the partition between the upper and lower compartments. During the mixing cycle each compartment functions independently of the other. At the inception of the mixing cycle the low water level sensor in the upper compartment will close the tank valve in the dividing partition once liquid in the upper compartment falls to a predetermined low limit level. The low water level sensor also actuates the water inlet valve to open the inlet valve and thereby allow water under pressure to flow into the upper compartment, preferably through a spray head.

When the level of water in the upper compartment reaches the high level sensor, the high level sensor closes the liquid inlet valve to shut off further flow of water into the upper compartment. Concurrently, the high level sensor also actuates audible and visual operator alarms. The alarms alert an attendant to the fact that the system is about to commence mixing of solid detergent.

In the simplest embodiment of the invention, a system operator, upon hearing an operator alarm, must manually add a predetermined quantity of dry detergent into the upper compartment and press an acknowledgement switch or pushbutton which terminates the alarm. Operation of this switch actuates an agitator to commence the agitation portion of the mixing cycle in which solid detergent is mixed into the solvent water. The mixing agitator operates for a predetermined period of time in order to dissolve the dry detergent in the upper compartment. Concurrently, the lower compartment, which is then isolated from the upper compartment, provides previously mixed detergent to satisfy the demands of washing machines to which the lower compartment is connected through supply lines and solenoid operated valves.

When the prescribed time period for mixing has elapsed, the mixing motor of the agitator is automatically shut off and the tank valve in the partition between the upper and lower compartments is automatically opened. Mixed liquid detergent thereupon descends under the force of gravity from the upper compartment into the lower compartment. The vent to the lower compartment prevents a back pressure from developing. After the mixing cycle the valve in the partition is opened and remains open so that the upper and lower compartments remain in open communication with each other until the liquid level in the upper compartment falls sufficiently to trigger the low level liquid sensor. The mixing cycle is thereupon repeated.

In a more sophisticated embodiment of the invention, an automatic dispensing device is added to the tank system previously described. This embodiment functions in the manner previously described except that when the audible alarm sounds, it is necessary only for the operator to visually inspect a hopper to ensure that a sufficient amount of dry detergent is available in the hopper for mixing in the upper compartment. The operator does not need to physically add a measured amount of detergent, as this function is performed by an automatic dispensing device. The automatic dispensing device dispenses dry solid detergent in aliquot quantities from the hopper into the upper compartment. Preferably, the automatic dispensing device includes a screw-type auger which meters an appropriate amount of solid detergent from the hopper and carries that metered quantity to the upper compartment.

Operation of the invention is controlled by a time sequencing means or system. The time sequencing system is operated by 110 to 120 volts 60 cycle alternating electrical current. The time sequencing system includes electronic components which respond to the high and low water level sensors to appropriately operate the water inlet valve, the mixer motor and the tank valve in the partition between the tank compartments.

The mixer timer for the mixer or agitator and the dispenser timer for metering solid detergent into the upper compartment are both independently adjustable. It is thereby possible to vary the operation of the automatic dispensing device, where such a device is employed, to accommodate different volumes of solvent and different dry chemical detergents which may require mixing in different quantities. Likewise, it is possible to adjust the duration of agitation to accommodate different volumes of solvent and different compositions and quantities of dry detergent to be dissolved.

The invention may be described with greater clarity and particularity by reference to the accompanying drawings.

DESCRIPTION OF THE EMBODIMENTS

Figure 1:
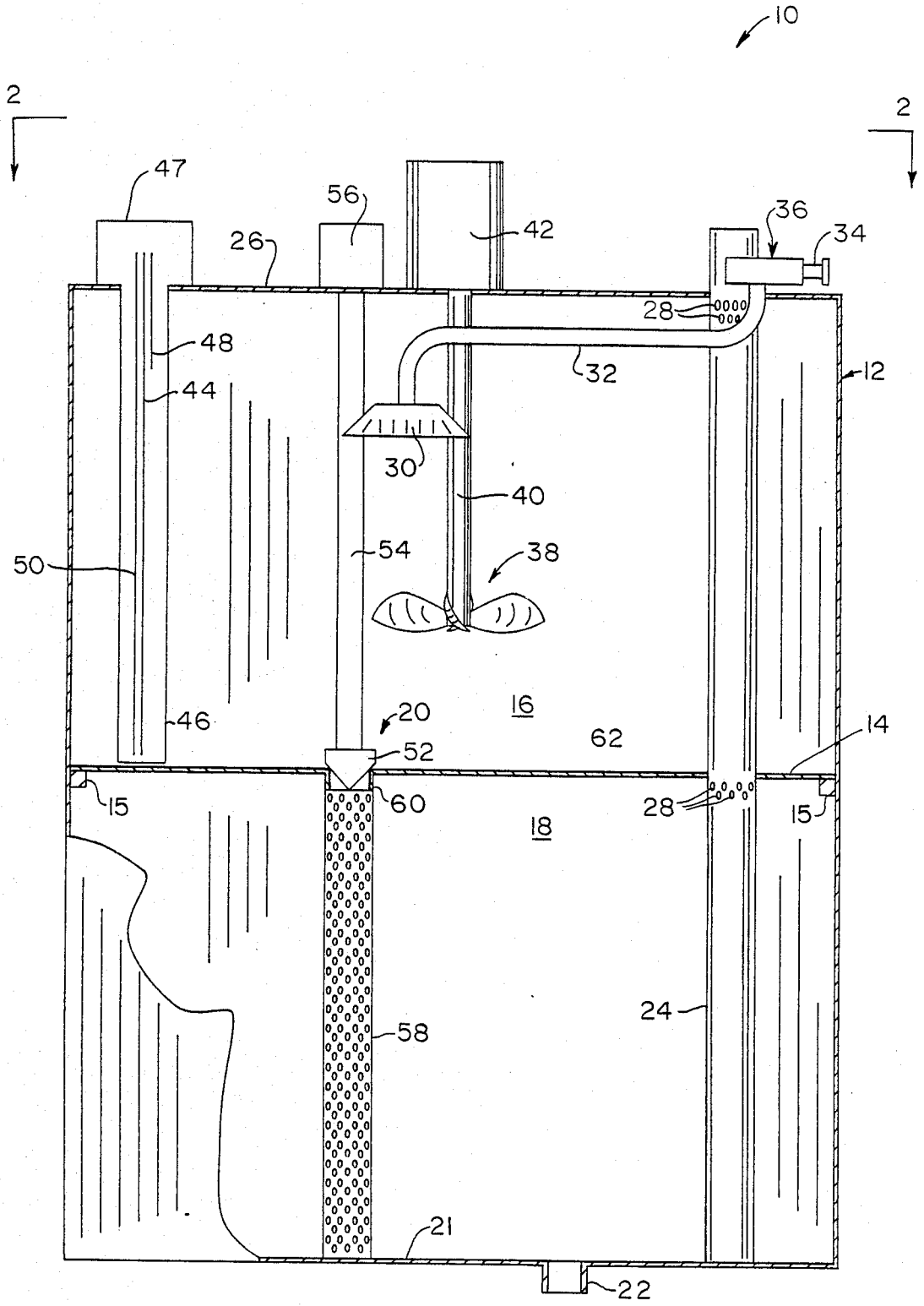
FIG. 1 a side elevational view, partially broken away, of one embodiment of the invention.

FIG. 1 illustrates a device 10 for dissolving solid detergent in a laundry. The device 10 is comprised of a generally cylindrical drum-shaped tank 12, The tank 12 is typically constructed of polyvinyl chloride or polyethylene and is of a size dictated by the requirements of the laundry facilities with which it is utilized. However, the tank 12 should have minimum dimensions of thirty inches in height and thirty inches in diameter. The tank 12 has an internal partition 14 that extends transversely thereacross to define an upper compartment 16 and a lower compartment 18 within the tank 12. The partition is solvent welded to and is supported at its periphery by a plastic annular support ring 15 which is solvent welded to the interior surface of the cylindrical wall of the tank 12. A liquid outlet drain 22 is located in the floor of the lower compartment 18 and is adapted for coupling to at least one washing machine in the laundry to supply liquid thereto upon demand.

A plastic tank valve 20 is located in the partition 14 and is operable to an open position to allow liquid to flow from the upper compartment 16 to the lower compartment 18 and alternatively to a closed position, as depicted in FIG. 1, to isolate the upper and lower compartments 16 and 18 from each other.

The tank valve 20 is a normally closed poppet valve having a closure plug 52 mounted at the lower extremity of a vertically oriented rod 54. The rod 54 is moved in vertical reciprocation by actuation and deactuation of an electrically operated solenoid 56.

A three inch diameter hollow, perforated polyvinyl chloride tube 58 is mounted on the floor 21 of the lower compartment 18. The tube 58 supports a downturned, annular flange 60 that depends from the transverse partition 14 directly beneath the poppet valve plug 52. The flange 60 and the upper edge of the tube 58 are solvent welded together where they meet. The tube 58 aids in supporting the floor 62 of the upper compartment 16 formed by the partition 14 when the upper compartment 16 contains a substantial quantity of liquid and the lower compartment 18 is not filled. The weight of solvent in the upper compartment 16 acting upon the floor 62 might otherwise break the liquid tight seal between the upper and lower compartments 16 and 18 at the annular support ring 15.

A cylindrical annular plastic standpipe 24 extends upwardly from the floor of the lower compartment 18, through the upper compartment 16 and through the roof 26 of the tank 12 and serves as a means for venting the lower compartment to atmosphere. The tubular standpipe 24 is preferably three inches in diameter and has openings 28 therein so that air can escape through the standpipe 24 from both the upper compartment 16 when it is filled and from the lower compartment 18 when liquid flows under the force of gravity from the upper compartment 16 through the valve 20 and into the lower compartment 18. The standpipe 24 passes through an aperture in the partition 14, which is solvent welded and sealed liquid tight to the outer surface of the standpipe 24. The standpipe 24 thereby also aids in supporting the partition 14.

A liquid inlet means is provided in the upper compartment 16 and includes a spray head 30 mounted on the end of a tube 32 that is connected to a liquid inlet port 34 through a solenoid operated liquid inlet valve 36. An electrical solenoid 64, depicted in FIG. 5, controls the operation of the inlet valve 36.

A mixing means is also provided in the upper compartment 16 and includes an agitator 38 having helical mixing blades extending radially outwardly from a vertically oriented drive shaft 40 that is turned in rotation by a mixing motor 42. The drive shaft 40 and the blades of the agitator 38 are preferably formed of number 304 stainless steel. The mixer motor 42 may be a one twentieth horsepower motor operable at 1500 revolutions per minute.

An upper limit sensing means is also located in the upper compartment 16 and includes a common electrical probe 44 that extends vertically downwardly within a protective annular tube 46 that is open at the bottom and closed at the top by a cap 47. The upper limit sensing means also include a much shorter electrical probe 48 that extends vertically downwardly within the tube 46 to a predetermined upper level limit in the upper compartment 16. When liquid rises to the level of the probe 48 in the upper compartment 16. The electrical circuit between the ground probe 44 and the upper limit probe 48 will produce an upper limit signal to the latching relay coil connections L1 depicted in FIG. 5.

A lower limit sensing means is also provided and includes a long probe 50 that extends downwardly within the shielding tube 46 to the level of the common probe 44. When liquid drops to a predetermined lower level limit beneath the lower extremities of the probes 44 and 50, electrical conductivity between the probes 44 and 50 changes thereby providing a low level signal to the latching relay coil connections L2 in FIG. 5. The electrical probes 44, 48 and 50 are preferably constructed of number 304 stainless steel.

Figure 5:
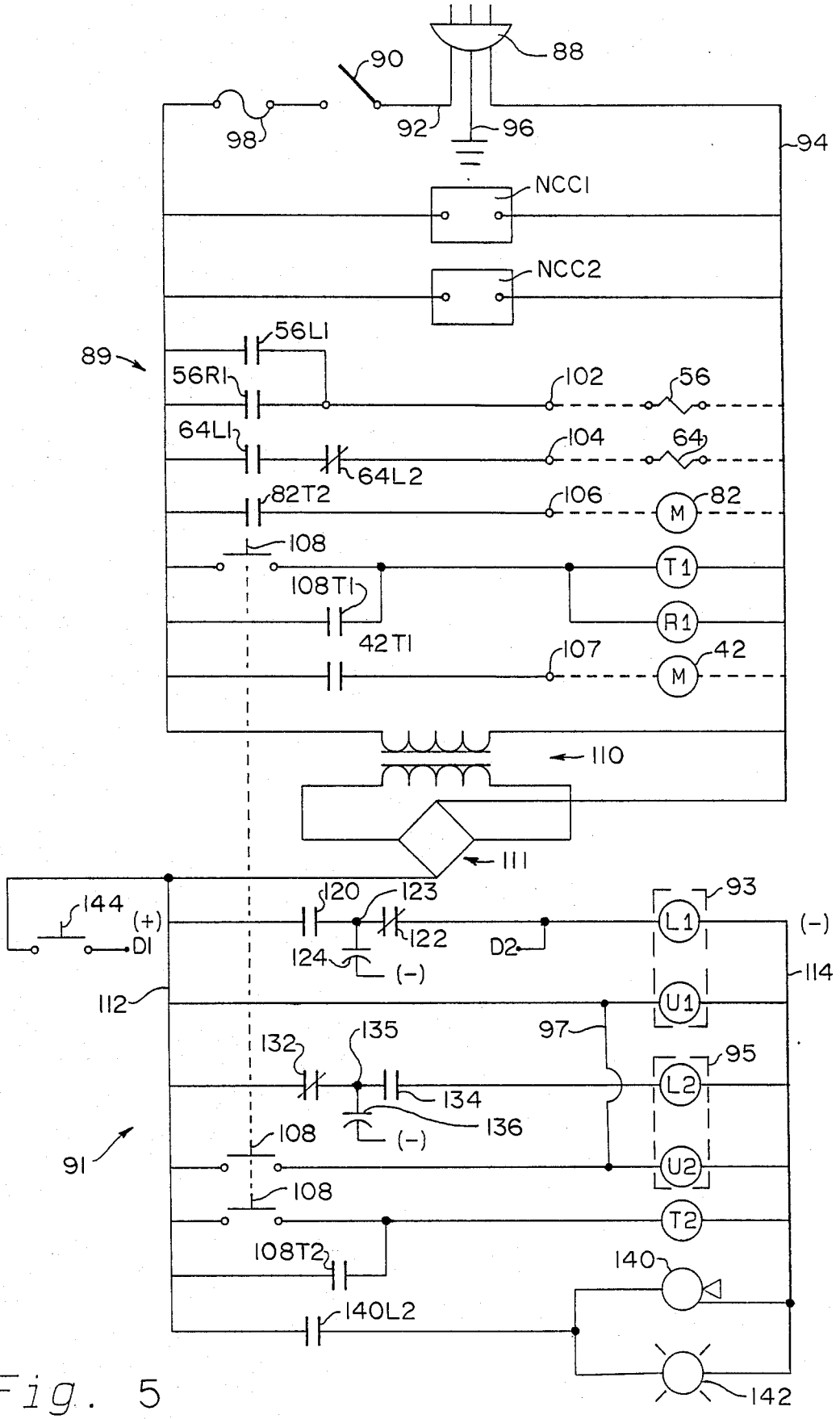
FIG. 5 is an electrical schematic diagram for the time sequencing control means of the invention equipped with the accessory of FIGS. 3 and 4.

To control the sequence of operation of the agitator 38 and the valves 20 and 36 an electrically operated cycling means or time sequencing means is provided. The electrical components of this time sequencing means are depicted schematically in FIG. 5. The electrical components of the cycle control or time sequencing means depicted in FIG. 5 are coupled to the tank valve solenoid 56, the liquid inlet valve solenoid 64, and the upper and lower limit sensing probes 44, 48 and 50. The solenoids 56 and 64 are operable separately and independently of each other.

The sequencing means of FIG. 5 serve to close the tank valve 20 and open the liquid inlet valve 36 in response to the signal produced on the probes 44 and 50 of the lower limit sensing means. The sequencing circuity of FIG. 5 thereafter initiates operation of the mixing agitator 38 by actuating the mixer motor 42 for a predetermined mixing time, and thereafter opens the tank valve 20 at the expiration of the predetermined mixing time.

Figure 2:
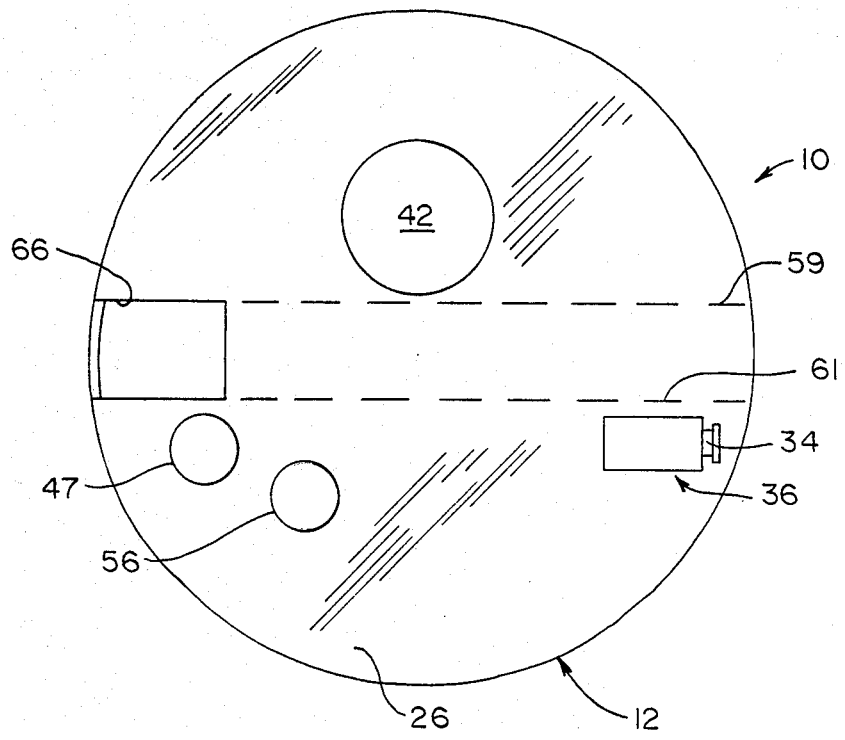
FIG. 2 is a plan view taken along the lines 2—2 of FIG. 1.

An access opening 66 is defined in the roof 26 of the tank 12 and is depicted in FIG. 2. Dry, solid, powdered or granular detergent is supplied to the upper compartment 16 of the device 10 through the access opening 66.

Figure 3:
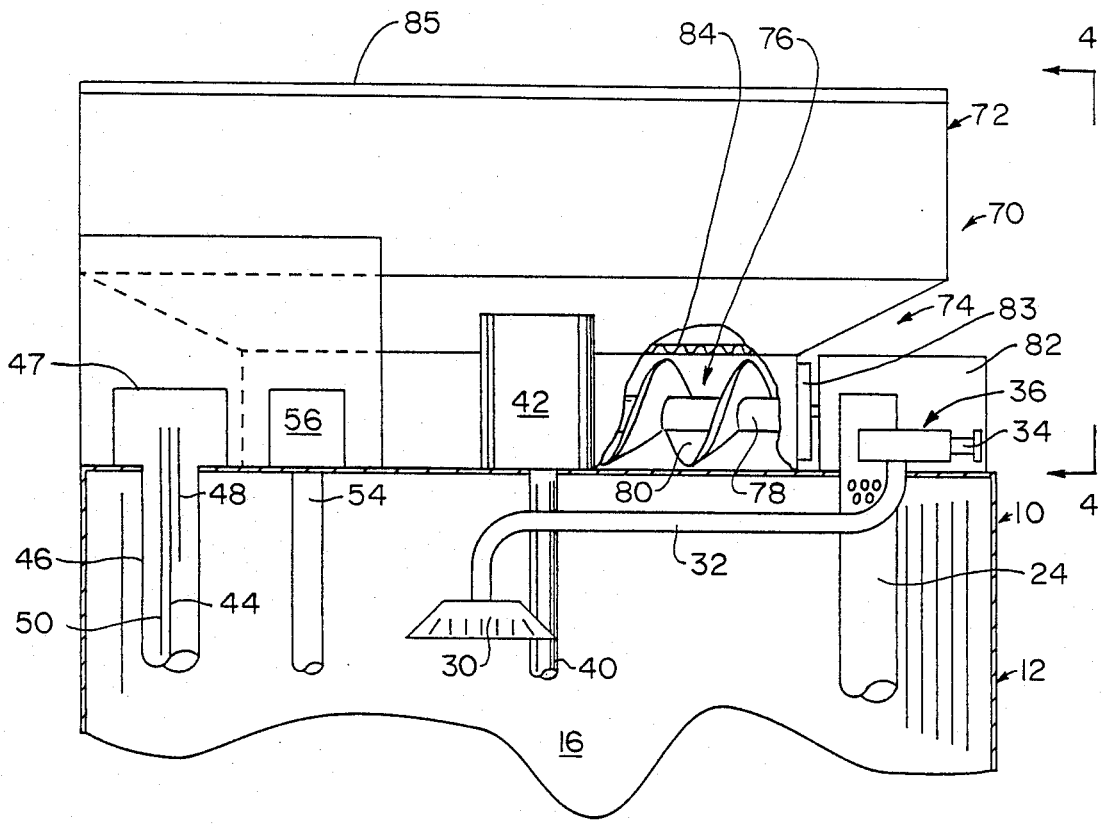
FIG. 3 is a partial side elevational view illustrating an optional accessory utilized with the embodiment of FIG. 1.
Figure 4:
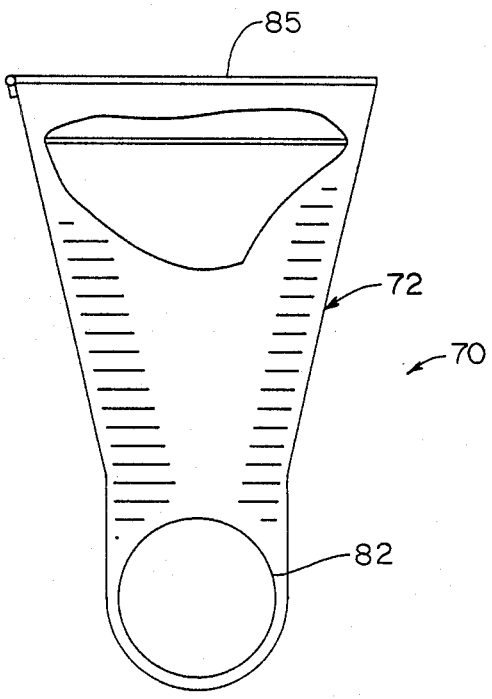
FIG. 4 is a sectional elevational detail taken along the lines 4—4 of FIG. 3.

FIGS. 3 and 4 illustrate an automatic dispensing device 70 which may optionally be utilized with the device 10 for dissolving solid detergent. When the optional automatic dispensing device 70 is employed it is located atop the roof 26 of the tank 12 in the area indicated by the dotted lines 59 and 61. The automatic dispensing device 70 includes a hopper 72 located above the upper compartment 16 and in communication therewith through the access opening 66 to admit solid detergent into the upper compartment 16. The hopper 72 receives dry, solid detergent and is covered by a hinged lid 85. The size of the hopper 72 will depend upon the size of the laundry installation to be serviced, but at the minimum should have a height of twenty inches, a width of sixteen inches and a length of twenty eight inches.

The automatic dispensing device 70 also includes a means 74 for dispensing aliquot quantities of dry, solid detergent from the hopper 72 to the upper compartment 16. This apportioning means 74 is disposed between the hopper 72 and the upper compartment 16 to receive detergent from the hopper 72 and convey a predetermined quantity of the detergent to the upper compartment 16. The aliquot dispensing or apportioning means 74 is comprised of a screw conveyor 76 formed with a horizontally disposed rotatable shaft 78 having a helical auger blade 80 projecting outwardly therefrom. The diameter of the auger blade 80 is normally between four and six inches. The auger shaft 78 is driven in rotation by 115 volt, alternating current, one quarter horsepower auger motor 82 through a gear box 83. The gear box 83 has a speed reduction ratio of one hundred to one.

The aliquot dispensing means 74 is also comprised of a detergent dispensing timer T2, depicted in FIG. 5, which actuates the screw conveyor 76 for a predetermined time in response to the high level signal from the electrical probes 44 and 48. The timer T2 is selectively adjustable to vary the duration of the predetermined dispensing time from between zero and five minutes.

As illustrated in FIG. 3, a sifting grate 84 is provided at the bottom of the hopper 72 and above the screw conveyor 76. The sifting grate 84 aids in ensuring that the solid detergent delivered to the screw conveyor 76 is provided in small particles in granular or powder form, rather in agglomerated chunks. While the screw conveyor 76 would be able to partially grind up agglomerated quantities of solid detergent, and in any event deliver solid agglomerated detergent into the access opening 66, the provision of the solid, dry detergent in agglomerated form would produce a significant deviation from the desired aliquot quantity.

The manner of operation of the sequencing circuitry may best be described in conjunction with the schematic diagram of FIG. 5. The sequencing circuitry derives power from a 110-120 volt, 60 cycle alternating current electrical supply through a wall plug 88. The device 10 is provided with a master switch 90 that opens the connection of the hot electrical line 92 relative to the neutral line 94. The line 96 from the plug 98 is grounded.

The sequencing circuitry of FIG. 5 also includes a step down transformer 110 and a rectifying bridge 111 which converts the alternating current to 12 volt direct current in order to operate a pair of memory relays 93 and 95. The positive DC supply line is indicated at 112 and the negative DC supply line is indicated at 114.

The system of the invention also includes an audible alarm in the form of a buzzer 140 and a visual alarm in the form of a light 142. The alarms 140 and 142 are coupled in parallel with each other and in series with normally open contacts 140L2. These contacts are closed upon latching actuation of the relay 95.

The sequencing circuitry is divided into a portion 89 which operates on alternating current and a portion 91 in which the voltage is stepped down and converted to 12 volt direct current power. The direct current circuit portion 91 is preferably employed for connection to those operating components that are in contact with water in the tank 12 to reduce the hazard of possible electrical shock.

The hot electrical line 92 in the alternating circuit portion 91 includes a protective fuse 98 and includes parallel connections to circuit control boards NCC1 and NCC2 which are respectively coupled to the lower limit sensing means which include the probes 44 and 50 and the upper limit sensing means which includes the probes 44 and 48. Suitable circuit control boards NCC1 and NCC2 are sold as the board model S127 by National Controls Corporation located in Chicago, Ill. These boards are intended for use to sense liquid levels based upon the conductivity of liquids between electrical probes.

Each of the circuit control boards operates a separate dual state latching relay. The lower level control board NCC1 operates a latching or memory rely 93 which has connections indicated at L1 for latching the relay coil to one stable state. Connections indicated at U1 are provided for unlatching the relay coil to return the coil to an alternative stable state. Due to their alternative effects on the relay contacts, relay connections L1 and U1 are indicated as separate schematic elements, although it is to be understood that L1 and U1 operate upon the same coil of the relay 93.

The relay 93 actuates and deactuates certain relay contacts. Specifically, coil connections L1 will actuate relay contacts 56L1 and 64L1. Coil contacts U1 will actuate relay contacts R1.

In addition to the contacts actuated by relay 93, there are certain other contacts which are physically mounted on the lower level control board NCC1. These contacts are located in the direct current circuit portion 91 of the sequencing circuitry of FIG. 5 and are indicated at 120 and 122. In the convention employed in the schematic diagram of FIG. 5 the normal condition of the contacts 120 and 122 is the condition that exists when the probe 50 is not in contact with liquid. That is, as long as the liquid level in the upper compartment 16 is above the level of the lower extremity of probe 50, contacts 120 are closed and contacts 122 are open. However, when the liquid level in compartment 16 drops below the lower extremity of probe 44, the contacts 120 and 122 revert to their normal condition in which contacts 120 are open and contacts 122 are closed.

In a similar manner the upper level circuit control board NCC2 operates a dual state memory relay 95 having coil connections L2 and U2 which, when alternatively actuated, change the relay coil from one stable, latched state to an alternative stable, unlatched state. The coil connections L2 actuate relay contacts 64L2.

The upper level circuit control board NCC2 has contacts 132 and 134 physically mounted thereon. These contacts are located in the direct current circuit portion 91 of the sequencing circuit of FIG. 5. Contacts 132 and 134 are indicated in their normal conditions which exist when the liquid level in compartment 16 is below the level of the lower extremity of probe 48. In this condition contacts 132 are normally closed and contacts 134 are normally open. When the liquid level in compartment 16 reaches probe 48, however, contacts 132 will open and contacts 134 will close.

Between each set of contacts physically mounted on the circuit control boards there is a triggering capacitor connected to d.c. ground. That is, capacitor 124 is connected between contacts 120 and 122 at junction 123 while capacitor 136 is coupled from d.c. ground to junction 135 between contacts 132 and 134. The triggering capacitors 124 and 136 are used, respectively, to trigger the latching relay connections L1 and L2. The capacitors 124 and 126 are preferably rated at 100 microfarads at 63 volts.

During an intermediate time that a supply of detergent solution exists in the upper compartment 16, the liquid level in compartment 16 will be above the level of probe 50 and below the level of probe 48. Under these conditions contacts 120 and 132 are closed and contacts 122 and 134 are open. Therefore, since there is no complete direct current circuit to either relay connections L1 or L2, both of the relays 93 and 95 will remain in the unlatched condition. When relay 95 is unlatched the solenoid 64, which is a pulling type solenoid, prevents water from entering compartment 16 through inlet valve 36. When relay 93 is unlatched the solenoid 56, which is a push type relay, will not close the tank valve 20. Consequently, the valve 20 remains open and detergent solution can flow freely under the force of gravity from the upper compartment 16 to the lower compartment 18 to replenish detergent solution withdrawn from the lower compartment 18 by washing machines connected thereto through the outlet 22.

However, when liquid level in the upper tank 16 falls below the predetermined low level limit set by the probe 50, the absence of liquid between the electrical contacts 44 and 50 generates a low level signal from the lower level circuit control board NCC1 which opens contacts 120 and closes contacts 122. When d.c. current is removed from capacitor 124, that capacitor, which has previously been charged from line 112, discharges through contacts 122, which have just opened. The discharge of capacitor 124 acts through relay coil connections L1 to latch relay 93 and close the normally open contacts 56L1 in the alternating current portion 89 of the sequencing control circuit. This supplies alternating current to the tank valve solenoid 56 through connecting block termination 102 to close the tank valve 20. Once the tank valve solenoid 56 is actuated, it remains actuated by virtue of the sustained closure of latching relay contacts 56L1. The valve 20 will remain closed until relay 93 is unlatched.

Concurrently, with actuation of solenoid 56 latching of the relay 93 closes the contacts 65L1. Alternating current is thereupon supplied to inlet valve solenoid 64 through contacts 64L1, contacts 64L2, which remain closed, and connecting block termination 104. Actuation of solenoid 64 opens the inlet valve 36. The actuated inlet valve solenoid 64 maintains the inlet valve 36 in an open condition until such time as the normally closed relay contacts 64L2 are opened.

With the tank valve 20 closed and the water inlet valve 36 opened, the upper compartment 16 will fill with water until the liquid level within the upper compartment 16 reaches the upper level limit probe 48. The state of contacts 120 and 122 is reversed as soon as the liquid level rises above the lower extremity probe 50. That is, contacts 120 revert to a closed condition while contacts 122 revert to an open condition. Because the relay 93 is a latching relay, however, this has no effect upon the condition of contacts 56L1 and 64L1. Therefore, solenoid 56 is maintained in a state of actuation so that the tank valve 20 remains closed.

Once the liquid level within compartment 16 reaches the lower extremity of the upper level limit probe 48, the circuit control board NCC2 is actuated. Contacts 132 will thereupon open and contacts 134 will close. The triggering capacitor 136, which has previously been charged with direct current from the d.c. line 112 through the previously closed contacts 132, will discharge through the contacts 134 which have just closed, thereby triggering the latching connections L2 of the relay 95. This switches the relay 95 from an unlatched to a latched condition. When this occurs the normally closed relay contacts 64L2 are opened, thereby removing electrical current from the inlet solenoid 64. As a result, inlet solenoid 64 closes inlet valve 36, thereby preventing any more water from entering the upper compartment 16 through the inlet port 34.

When relay 95 is switched from an unlatched to a latched condition, the normally open relay contacts 140L2 close, thereby actuating both an audible alarm 140 and a visual alarm 142. Since the automatic dispensing device 70 is in operation, the only action required on the part of the attendant is to open the lid 85 of the hopper 72 to see that sufficient detergent remains within the hopper 72. If so, the attendant merely presses the acknowledgement pushbutton 108 to cause the sequencing circuitry to continue in operation.

Depression of the pushbutton 108 has several effects. Depression of the pushbutton 108 provides electrical current to the timer T1 and to a relay coil R1. The pushbutton 108 also triggers the relay unlatching connections U2 in the relay 95, thereby switching the relay 95 from a latched to an unlatched condition. The unlatching connections U1 and U2 of the relays 93 and 95, respectively, are coupled together by a jumper 97. Therefore, depression of the acknowledgement pushbutton 108 also causes the relay 93 to switch from the latched to an unlatched condition. Pushbutton 108 also provides current to timers T1 and T2.

The net result of unlatching relays 93 and 95 is that the contacts 56L1, 64L1 and 140L2 revert to their normally open condition, while contacts 64L2 revert to their normally closed condition. Opening of the contacts 56L1 opens one of the parallel paths to the tank solenoid 56. However, as previously noted, closure of the acknowledgement pushbutton 108 concurrently triggers relay R1 thereby closing the normally open contacts 56R1 which are connected to the connecting block termination 102. Therefore, solenoid 56 continues to remain actuated since a current path exists through contacts 56R1 and connecting block termination 102. However, opening of the contacts 64L1 creates an open circuit condition which prevents the solenoid 64 from being reactuated, even though contacts 64L2 are concurrently closed. Finally, opening of the relay contacts 140L2, as a result of unlatching of the relay 95, extinguishes the alarm horn 140 and the alarm light 142.

The auger motor 82 is normally deactuated and is only actuated upon actuation of the timer circuit T2 by the depression of the acknowledgement pushbutton 108. Once the timer circuit T2 is actuated, contacts 82T2 will close for the predetermined dispensing interval to which the timer T2 is set. The timer T2 may be set for any interval of between zero and five minutes. As previously noted, the timer T2 is closed by depression of the pushbutton 108. Once the pushbutton 108 is depressed, the normally open contacts 82T2 and 108T2 will remain closed until expiration of the predetermined dispensing period. The auger motor 82 is thereby actuated for that period, since current is supplied thereto through connecting block termination 106.

The acknowledgement pushbutton 108 is also used to actuate the mixer timer T1. The mixer timer T1 also is adjustable and may be set for any period of time from between zero and sixty minutes duration. Once the timer T1 has been actuated, all of the normally open T1 contacts will close. That is, depression of the pushbutton 108 will actuate the timer T1 and cause normally open contacts 108T1 and normally open contacts 42T1 to close for the duration of the predetermined mixing interval to which the timer T1 has been adjusted. The mixing motor 42 will receive electrical current through connecting block termination 107 and operate the agitator 38 until timer T1 times out and the contacts 42T1 return to their open condition. Also, relay R1 will remain enabled, thereby holding relay contacts 56R1 closed so that solenoid 56 remains enabled. The tank valve 20 will therefore remain closed during the time interval set by timer T1. Once timer T1 does time out, however, contacts 108T1, 56R1 and 42T1 open, thereby halting operation of the mixing motor 42 and deacting solenoid 56 to open the tank valve 20.

As previously noted, the apparatus 10 may be utilized with or without the automatic detergent dispensing device 70. The foregoing explanation of the operation of the sequencing circuitry has been explained with respect to a system employing an automatic dispensing device 70. When the auger motor 82 is operated, the auger will receive detergent from the hopper 72 and advance that detergent toward the opening 66 in the roof 26 of the tank 12 for a predetermined period of time. Since the auger motor 82 operates at a constant speed, the duration of the detergent dispensing time of operation, which is established by the time setting of the timer T2, will determine the quantity of detergent carried from the hopper 72 and dispensed into the opening 66 in the roof 26 of the tank 12.

Alternatively, when no automatic dispensing device is present, neither the auger motor 82 nor the timer T2 will be present in the sequencing circuitry. However, all of the other circuit components depicted in FIG. 5 will operate in the manner previously described. In such a simplified system, however, it is necessary for the attendant to load a measured amount of detergent into the tank 12 through the opening 36 prior to pressing the acknowledgement button 108.

The direct current portion 91 of the sequencing circuitry of FIG. 5 also includes a testing button 144. The testing button 144 is provided in order to simulate a low liquid level condition. When the test button 144 is depressed, direct electrical current is provided from contact D1 to contact D2, thereby bypassing the contacts 120 and 122 and the capacitor 124 to trigger the latching connections L1 in order to latch the relay 93. The testing button 144 is used only for testing purposes in order to adjust the timers T1 and T2 and to ensure proper operation of the circuitry. The testing button 144 normally remains open, as depicted in FIG. 5.

System Operation

The master switch 90 must always be closed in order to provide power to the system to enable the detergent mixing and dispensing device 10 to operate. When the switch 90 is closed the relay contacts 56L1, 56R1 and 64L1 will remain open until such time as the liquid level in the upper compartment 16 falls below the level of the contact 50 depicted in FIG. 1. When this does occur, the conductivity between probes 50 and 44 changes. The relay 93 is triggered from the unlatched to the latched condition and the normally open contacts 56L1 will close, thereby actuating the solenoid 56 and closing the tank valve 20. At the same time, the normally open relay contacts 64L1 will close so that a complete circuit is established from the alternating current hot line 92 through the contacts 64L1 and the normally closed contacts 64L2 to the inlet valve solenoid 64. The inlet valve solenoid 64 thereupon admits water through the inlet port 34 and through the inlet valve 36 to the spray head 30. Water is sprayed into the upper compartment 16 through the spray head 30 and will not drain into the lower compartment 18, since the valve 20 is closed. The water level will thereupon rise within the upper compartment 16 until it reaches the level of the high level sensing contact 48.

Once the solvent level in the upper compartment 16 reaches the predetermined upper level, the normally closed contacts 64L2 are opened. Opening of the contacts 64L2 deactuates the solenoid 64, thereby closing the water inlet valve 36. Generation of the high level signal due to change of conductivity between the electrical probes 44 and 48 also closes the normally open contacts 140L2. When contacts 140L2 are closed, a direct current signal is provided to both the audible alarm 140 and the visual alarm 142. An operator in the vicinity is thereby informed that the upper compartment 16 has been filled with solvent. The operator then pushes the acknowledgment button 108. If the automatic dispensing device 70 is not employed, the operator must add a predetermined, measured amount of dry chemical detergent suitable for use with the volume of water in the upper compartment 16.

Depression of the acknowledgement button 108 closes the circuit to the mixer timer T1 and also enables the relay R1. Closure of the relay R1 closes the normally open relay contacts 56R1, thereby ensuring that the tank valve solenoid 56 remains actuated so that the tank valve 20 remains closed. Once the timer T1 is actuated the normally open relay contacts 108T1 are closed for the duration of the predetermined interval for which the mixer timer T1 has been set.

Actuation of the timer T1 also closes the normally open contacts 42T1 for the duration of the predetermined interval of actuation of the timer T1, thereby driving the agitator motor 42 during this predetermined interval. The agitator motor 42 causes the vanes of the agitator 38 to stir the liquid within the upper compartment 16, thereby promoting the dissolution of the solid, chemical detergent into the solvent water in the upper compartment 16.

Once the predetermined interval established by the mixer timer T1 has elapsed, the contacts 108T1 and 42T1 will return to their normally open positions. When the contacts 42T1 open, electrical current is removed from the mixer motor 42, whereupon operation of the agitator 38 ceases. Likewise, when the contacts 108T1 open, current is removed from the timer T1 and also from the relay R1.

Removal of electrical current from the relay R1 returns the contacts 56R1 to their normally open condition. The parallel connection of the contacts 56L1 by this time will already have been returned to their normally open condition, since those contacts are opened as soon as the water inlet valve 36 is opened to raise the level of solvent water in the upper compartment 16 above the lower extremity of the low level contact probe 50. Therefore, once timer T1 times out, electrical current will be removed from the tank valve solenoid 56 since open circuit conditions exist in both of the alternative parallel paths through the relay contacts 56L1 and the relay contacts 56R1.

Removal of electrical current from the tank valve solenoid 56 causes the valve closure plug element 52 to lift off of the valve seat defined at the annular flange 60. The solution of liquid detergent is then free to flow from the upper compartment 16 down into the tube 58 and radially outwardly therefrom through the perforations therein into the enclosure of the lower compartment 18. The detergent solution can then be withdrawn through the drain outlet 22 upon demand from one or more washing machines.

It should be noted that during the time that the tank valve solenoid 56 is actuated by electrical current through either of the alternative paths through the relay contacts 56L1 or 56R1, the lower compartment 18 is isolated from the upper compartment 16. During this time the upper compartment 16 serves as a mixing compartment, while the lower compartment 18 serves as a reservoir. Detergent solution previously received in the lower compartment 18 from the upper compartment 16 is available during the mixing cycle for use by washing machines in communication with the outlet drain 22. The standpipe 24 prevents any vacuum or back pressure from forming within the lower compartment 18 as detergent solution is drawn therefrom through the drain outlet 22, or received from the upper compartment 16 through the tank valve 20. Likewise, the standpipe 24 prevents any back pressure from developing within the upper compartment 16 when the inlet valve 36 is opened and water enters the water inlet port 34.

When the automatic dispensing device 70 is utilized with the apparatus 10, the cycling circuitry of FIG. 5 functions in the same manner, but with added features. With the automatic dispensing device 70 in operation, however, the only action required on the part of the operator upon sounding of the horn 140 and illumination of the light 142 is to visually inspect the dry chemical hopper 72 to ensure that sufficient dry chemicals are available for mixing of a new batch of detergent solution in the upper compartment 16. All that is required in this regard is for the operator to lift the lid 85 of the hopper 72 and look downwardly to see if the grate 84 is visible. As long as the grate 84 is covered, there will be sufficient dry detergent to mix a new batch of detergent solution in the upper chamber 16.

Upon verifying that adequate dry detergent exists in the hopper 72, the operator then pushes the alarm acknowledgement pushbutton 108. Depression of the alarm acknowledgement pushbutton 108 closes the circuit between the direct current supply lines 112 and 114 to the auger timer T2. Actuation of the auger timer T2 closes the timer relay contacts 108T2 for the duration of the predetermined period for which the timer T2 is set. The timer T2 may be set for any time period between zero and five minutes. Actuation of the auger timer T2 closes contacts 82T2 to the auger motor 82 until the solvent dispensing period has elapsed. At the expiration of the detergent dispensing period, the relay contacts 82T2 will return to their normally open condition, whereupon operation of the auger motor 82 ceases.

During operation of the auger motor 82 detergent which is received from the hopper 72 through the grate 84 is carried laterally to the left as viewed in FIG. 2 by the auger blade 80 until it reaches the opening 66 in the roof 26 of the tank 12. The screw conveyor 76 thereby functions in combination with the hopper 72 to dispense aliquot quantities of dry detergent into the upper compartment 16. The amount of the metered quantity is determined by the time period for which the timer T2 is set, since operation of the auger motor 82 will transport a uniform amount of dry detergent from the hopper 72 to the opening 66 for each unit time of operation of the motor 82.

With or without the automatic dispensing devices 70, the acknowledgment pushbutton 108 will actuate the timer T1. When the acknowledgement pushbutton 108 is closed alternating electrical current is supplied to the timer T1, thereby closing the normally open relay contacts 108T1 for the duration of the mixing interval set by the timer T1. Also, during the time that the relay contacts 108 T1 are closed, the relay R1 is actuated, thereby closing the normally open relay contacts 56R1. Closure of the relay contacts 56R1 provides a path of electrical alternating current to maintain the tank valve solenoid 56 in an actuated condition, thereby keeping the tank valve 20 closed, as depicted in FIG. 1. As long as the tank valve 20 remains closed, the upper mixing compartment 16 and the lower reservoir compartment 18 are isolated from each other.

Actuation of the timer T1 also closes the normally open relay contacts 42 T1 to actuate the mixing motor 42. Actuation of the mixing motor 42 causes the motor 42 to operate the agitator 38 to promote the dissolution of the solid detergent powder or granules received in the upper compartment 16 through the access opening 66.

At the termination of the mixing cycle established by the setting of the mixing timer T1 the relay contacts 42T1 and 108T1 return to their normally opened conditions, since by this time the relay 93 will have been unlatched by triggering of the unlatching coil connections U1. Once the tank valve solenoid 56 is deactuated, the tank valve 20 is opened, thus allowing the mixed, detergent solution to flow from the upper tank compartment 16 into the lower tank compartment 18.

With or without the automatic dispensing device 70, the upper compartment 16 serves as a mixing chamber while the lower compartment 18 serves as a reservoir during the mixing cycle when the tank valve 20 is closed. Once the tank valve opens, the upper and lower compartments 16 and 18 are in communication with each other and function as a single reservoir.

The dry automatic detergent liquifying system of the invention can be utilized in any type of laundry, but is particularly advantageous where dry chemical detergents are to be dissolved in a liquid solvent, such as water, and where a minimum space is available. However, it must be appreciated that the invention is not limited to the laundry industry. With the automatic dispensing device the system of the invention will automatically measure exact amounts of dry detergent chemicals and deliver these apportioned quantities for dissolution into exactly measured quantities of water for automatic dispensing to washing machines, or any other device that requires this type of automatic dispensation. The batch amounts of chemicals to be dissolved will vary from one quarter of one pound to an unlimited number of pounds, depending upon the requirements and recommendations of the chemical supplier.

Numerous variations and modifications of the invention will become readily apparent to those familiar with processes for dissolving dry chemicals in a liquid. Accordingly, the scope of the invention should not be construed as limited to the specific embodiments depicted and described, but rather is defined in the claims appended hereto.

I claim:

1. An apparatus for dissolving solid detergent for use in a laundry comprising:

a tank having upper and lower compartments, a tank valve located between said upper and lower compartments and selectively operable to permit communication therebetween and alternatively to isolate said compartments from each other, a vent to atmosphere from said compartments, a liquid outlet from said lower compartment, a liquid inlet to said upper compartment, an inlet valve in said liquid inlet selectively operable between open and closed positions, an agitator located in said upper compartment, a high level indicator for producing a high level signal when liquid in said upper compartment rises to a predetermined high level, a low level indicator for producing a low level signal when liquid in said upper compartment falls to a predetermined low level, mixing timer means for producing a timing signal a predetermined interval after actuation, cycling means which closes said tank valve and opens said inlet valve in response to said low level signal, and which thereafter actuates said agitator and said mixing timer means, and which deactuates said agitator and opens said tank valve in response to said timing signal.

2. An apparatus according to claim 1 further characterized in that said cycling means is electrically operated and each of said valves is controlled by a separate electrical solenoid.

3. An apparatus according to claim 1 further characterized in that said timer means is adjustable to vary the duration of said predetermined interval.

4. An apparatus according to claim 1 further comprising an alarm which is actuated in response to said high level signal.

5. An apparatus according to claim 1 further comprising a hopper disposed above said upper compartment to receive dry, solid detergent.

6. An apparatus according to claim 5 further comprising means for dispensing aliquot quantities of dry, solid detergent from said hopper into said upper compartment.

7. An apparatus according to claim 6 wherein said means for dispensing is comprised of a screw conveyor and a detergent dispensing timer which actuates said screw conveyor for a predetermined period of time in response to said high level signal.

8. An apparatus according to claim 7 wherein said detergent dispenser timer is selectively adjustable to vary the duration of said predetermined period of time.

9. A device for dissolving solid detergent for use in a laundry comprising:

a tank, a partition extending transversely across said tank to define upper and lower compartments therewithin, a tank valve located in said partition and operable to an open position to allow liquid to flow from said upper compartment to said lower compartment and operable alternatively to a closed position to isolate said upper and lower compartments from each other, liquid outlet means for coupling said lower compartment to at least one washing machine to supply liquid thereto, means for venting said compartments to atmosphere, mixing means located in said upper compartment, liquid inlet means in said upper compartment for admitting liquid thereto, a liquid inlet valve located at said liquid inlet means, upper limit sensing means located in said upper compartment for providing a signal when liquid rises to a predetermined upper level in said upper compartment, lower limit sensing means located in said upper compartment for providing a signal when liquid drops below a predetermined lower level in said upper compartment, and time sequencing means coupled to said tank valve, said liquid inlet valve and said upper and lower limit sensing means to close said tank valve and open said liquid inlet valve in response to said signal from said lower limit sensing means, to close said liquid inlet valve in response to said signal from said upper limit sensing means, to thereafter initiate operation of said mixing means for a predetermined mixing time, and to open said tank valve at the expiration of said predetermined mixing time.

10. A device according to claim 9 further comprising:

hopper means located above said upper compartment and in communication therewith to admit solid detergent into said upper compartment.

11. A device according to claim 10 further comprising apportioning means disposed between said hopper means and said upper compartment to receive dry, solid detergent from said hopper means and convey a predetermined quantity of said dry, solid detergent to said upper compartment.

12. A device according to claim 11 wherein said apportioning means is comprised of a screw conveyor and a dispenser timer connected to actuate said screw conveyor for a predetermined dispensing time in response to said signal from said upper limit sensing means.

13. A device according to claim 12 in which said dispenser timer is adjustable to selectively vary the duration of said predetermined dispensing time.

14. A device according to claim 12 further comprising a sifting grate located in said hopper means and above said screw conveyor.

15. A device according to claim 9 further comprising an alarm connected for actuation by said signal from said upper limit sensing means.

16. A device for dissolving solid detergent for use in at least one washing machine comprising:

a tank having transverse partition means defining upper and lower compartments respectively located above and below said partition means, liquid outlet means in said lower compartment which permits withdrawal of liquid detergent solution therefrom, vent means for venting said compartments to atmosphere, a tank valve in said transverse partition means which is operable alternatively between an open position to permit liquid flow from said upper compartment to said lower compartment and a closed position to isolate said upper and lower compartments from each other, a liquid inlet in said upper compartment to admit liquid solvent, an inlet valve in said liquid inlet, a hopper located above said upper compartment to receive solid detergent to be dissolved and to dispense said solid detergent into said upper compartment, agitating means located in said upper compartment to promote dissolution of said solid detergent into a solvent in said upper compartment, high level signaling means to provide a high level signal when solvent rises to a predetermined upper limit in said upper compartment, low level signaling means to provide a low level signal when liquid falls to a predetermined lower limit in said upper compartment, agitator timing means for producing a timing signal a predetermined interval after actuation, sequencing means that is: (a) responsive to said low level signal to open said inlet valve and close said tank valve, (b) responsive to said high level signal to close said inlet valve, and (c) responsive to said timing signal to deactuate said agitating means and open said coupling valve.

17. A device according to claim 16 wherein said sequencing means is electrically actuated and further comprising separate solenoid actuators for each of said valves.

18. A device according to claim 17 further comprising means for withdrawing solid detergent from said hopper and for dispensing a predetermined quantity of dry, solid detergent into said upper compartment.

19. A device according to claim 18 in which said means for withdrawing includes a screw conveyor located beneath said hopper and above said upper compartment and a conveyor timer for operating said screw conveyor for a predetermined dispensing period.

20. A device according to claim 19 in which said conveyor timer is adjustable to vary the duration of said dispensing period.

* * * * *